US008864545B2

(12) United States Patent
Perdomo

(10) Patent No.: US 8,864,545 B2
(45) Date of Patent: Oct. 21, 2014

(54) RADIO FREQUENCY CONTROLLED AIRCRAFT

(76) Inventor: Orestes R. Perdomo, Miami, FL (US)

( * ) Notice: Subject to any disclaimer, the term of this patent is extended or adjusted under 35 U.S.C. 154(b) by 207 days.

(21) Appl. No.: 13/250,103

(22) Filed: Sep. 30, 2011

(65) Prior Publication Data

US 2013/0084766 A1 Apr. 4, 2013

(51) Int. Cl.
*A63H 27/04* (2006.01)
*A63H 27/24* (2006.01)

(52) U.S. Cl.
CPC ..... *A63H 27/04* (2013.01)
USPC ..... 446/33; 446/57

(58) Field of Classification Search
USPC ..... 446/30, 31, 32, 33, 34, 57, 58
See application file for complete search history.

(56) References Cited

U.S. PATENT DOCUMENTS

| | | | | |
|---|---|---|---|---|
| 1,201,839 | A | 10/1916 | McCoole | |
| 2,034,298 | A | 3/1936 | Holman | |
| 2,061,953 | A | 11/1936 | Sampson | |
| 2,292,705 | A | 8/1942 | Lohse | |
| 2,299,582 | A | 10/1942 | Lohse | |
| 2,404,922 | A | 7/1946 | Padgett | |
| 2,409,168 | A | 10/1946 | Walker | |
| 2,611,213 | A | 9/1952 | Johnson et al. | |
| 2,624,152 | A | 1/1953 | Sneed | |
| 2,791,427 | A | 5/1957 | Johnson | |
| 2,968,119 | A * | 1/1961 | Glass et al. | 446/33 |
| 2,968,482 | A | 1/1961 | Gjertsen | |
| 2,977,117 | A | 3/1961 | Taylor | |
| 3,080,676 | A * | 3/1963 | Stanzel | 446/33 |
| 3,110,127 | A | 11/1963 | Benesch | |
| 3,222,815 | A | 12/1965 | Struck | |
| 3,373,505 | A | 3/1968 | Tucker | |
| 3,616,568 | A * | 11/1971 | Powell | 446/50 |
| 3,705,720 | A | 12/1972 | Nicholls | |
| 3,731,424 | A | 5/1973 | Meyer | |
| 3,740,032 | A | 6/1973 | Chang | |
| 3,743,279 | A | 7/1973 | Chang | |
| 3,762,702 | A | 10/1973 | Keele et al. | |
| 3,857,194 | A | 12/1974 | Guttman | |

(Continued)

FOREIGN PATENT DOCUMENTS

GB 1502789 3/1978

OTHER PUBLICATIONS http://www.helipal.com/rc-plane_nine-eagles-airplane.html, Apr. 15, 2011.
http://www.youtube.com/watch?v=HcpK4N-Yg3A, Apr. 21, 2011.

*Primary Examiner* — John Ricci
(74) *Attorney, Agent, or Firm* — Simpson & Simpson, PLLC

(57) ABSTRACT

A radio-controlled model airplane, including: a fuselage; first and second wings connected to the fuselage; and a control system including: a battery; a receiver powered by the battery and arranged to receive radio frequency signals; and a computer powered by the battery, electrically connected to the receiver, and arranged to transmit control signals in response to the received radio frequency signals. The airplane also includes a first motor powered by the battery and arranged to receive the transmitted control signals to rotate a propeller; and a single flexible wire: passing through an opening in a distal end of the first wing; with a first end fixed to a point at or near a junction of the first wing and the fuselage; and with a second end for connection to a point outside of the model airplane.

20 Claims, 6 Drawing Sheets

(56) References Cited

U.S. PATENT DOCUMENTS

| | | | | | |
|---|---|---|---|---|---|
| 3,957,230 | A | | 5/1976 | Boucher et al. | |
| 3,991,512 | A | * | 11/1976 | Stanzel | 446/33 |
| 4,011,684 | A | | 3/1977 | Stanzel | |
| 4,116,432 | A | | 9/1978 | Feeney | |
| 4,135,711 | A | | 1/1979 | Holt | |
| 4,154,443 | A | | 5/1979 | Schmalzbauer | |
| 4,222,558 | A | | 9/1980 | Tinguely et al. | |
| 4,246,724 | A | * | 1/1981 | Vechot | 446/32 |
| 4,981,456 | A | | 1/1991 | Sato et al. | |
| 5,030,156 | A | | 7/1991 | Savicki, Sr. | |
| 5,104,344 | A | | 4/1992 | Jancso, Jr. | |
| 5,709,580 | A | * | 1/1998 | Stanzel | 446/31 |
| 6,572,482 | B1 | * | 6/2003 | Lewis, Jr. | 472/9 |

* cited by examiner

RADIO FREQUENCY CONTROLLED AIRCRAFT

FIELD OF THE INVENTION

The invention relates generally to a radio-controlled model airplane and system, in particular, a model airplane and system using a flexible guide wire.

BACKGROUND

U.S. Pat. No. 4,116,432 teaches a model aircraft with an on-board gasoline engine connected to a post by a three-point connection to cable connected to a rotatable and vertically displaceable ring placed about the post. Feeney does not teach any control of the aircraft. The aircraft starts on the ground, flies upward until the cable reaches an end point of the post and then flies in this position until the engine runs out of gasoline.

U.S. Pat. No. 2,292,705 teaches a model aircraft with an on-board engine with a wire connected to a wing tip and to a post. The post includes a spiral configuration by which the wire is able to move up and down the post. The spiral configuration severely limits the type of movement possible for the aircraft.

Patent GB 1502789 teaches model airplanes connected with respective wires to fixed points on a post. The wire is connected to the wing of an airplane and provides electrical power for an engine in the airplane. U.S. Pat. No. 4,135,711 teaches model airplanes connected to a post by wires supplying electrical power for on-board motors. The wires are connected to the fuselage without touching the wing.

It is known to use a solid, non-flexible rod to connect a model airplane to a central post. In some instances the airplane includes an on-board motor receiving power via the rod and in some instances the airplane does not have an on-board motor and the rod rotates to propel the airplane.

SUMMARY

According to aspects illustrated herein, there is provided a radio-controlled model airplane, including: a horizontal stabilizer with a controllable rear elevator hingedly connected to the horizontal stabilizer; first and second wings including first and second controllable flaps hingedly connected to the first and second wings, respectively; and a control system including: a battery; a receiver powered by the battery and arranged to receive radio frequency signals; and a computer powered by the battery, electrically connected to the receiver, and arranged to transmit control signals in response to the received radio frequency signals. The airplane also includes: a first motor powered by the battery and arranged to receive the transmitted control signals to rotate a propeller; and a second motor powered by the battery and arranged to receive the transmitted control signals to: swivel, with respect to a same frame of reference, the first and second flaps in a clockwise direction and to swivel the rear elevator in a counter clockwise direction; or swivel, with respect to the same frame of reference, the first and second flaps in the counterclockwise direction and the rear elevator in the clockwise direction.

According to aspects illustrated herein, there is provided a radio-controlled model airplane, including: a fuselage; first and second wings connected to the fuselage; and a control system including: a battery; a receiver powered by the battery and arranged to receive radio frequency signals; and a computer powered by the battery, electrically connected to the receiver, and arranged to transmit control signals in response to the received radio frequency signals. The airplane also includes a first motor powered by the battery and arranged to receive the transmitted control signals to rotate a propeller; and a single flexible wire: passing through an opening in a distal end of the first wing; with a first end fixed to a point at or near a junction of the first wing and the fuselage; and with a second end for connection to a point outside of the model airplane.

According to aspects illustrated herein, there is provided a radio-controlled model airplane, including: a fuselage; a horizontal stabilizer with a controllable rear elevator connected to the horizontal stabilizer; first and second wings connected to the fuselage and including first and second controllable flaps hingedly connected to the first and second wings, respectively; and a control system including: a battery; a receiver powered by the battery and arranged to receive radio frequency signals; and a computer powered by the battery, electrically connected to the receiver, and arranged to transmit control signals in response to the received radio frequency signals. The airplane also includes: a first motor powered by the battery and arranged to receive the transmitted control signals to rotate a propeller; and a single flexible wire: passing through an opening in a distal end of the first wing; with a first end fixed to a point at or near a junction of the first wing and the fuselage; and with a second end for connection to a point outside of the model airplane. The airplane also includes a second motor powered by the battery and arranged to receive the transmitted control signals to: swivel, with respect to a same frame of reference, the first and second flaps in a clockwise direction and to swivel the rear elevator in a counter clockwise direction; or swivel, with respect to the same frame of reference, the first and second flaps in the counterclockwise direction and the rear elevator in the clockwise direction.

According to aspects illustrated herein, there is provided a model airplane system, including: an anchoring system including: a base; a pylon fixedly secured to the base; a ring disposed about the pylon, rotatable about the pylon, and displaceable along a length of the pylon; a single flexible wire with a first end connected to the ring; and a cap at a distal end of the pylon to prevent the ring from displacing past the distal end. The system also includes a radio-controlled model airplane including: a horizontal stabilizer with a rear elevator connected to the horizontal stabilizer; first and second wings including first and second flaps connected to the first and second wings, respectively; and a control system including: a battery; a receiver powered by the battery and arranged to receive radio frequency signals; and a computer powered by the battery, electrically connected to the receiver, and arranged to transmit control signals in response to the received radio frequency signals. The airplane includes: a first motor powered by the battery and arranged to receive the transmitted control signals to rotate a propeller; and a second motor powered by the battery and arranged to receive the transmitted control signals to: swivel, with respect to a same frame of reference, the first and second flaps in a clockwise direction and to swivel the rear elevator in a counter clockwise direction; or swivel, with respect to the same frame of reference, the first and second flaps in the counterclockwise direction and the rear elevator in the clockwise direction.

According to aspects illustrated herein, there is provided a model airplane system, including: an anchoring system including: a base; a pylon fixedly secured to the base; a ring disposed about the pylon, rotatable about the pylon, and displaceable along a length of the pylon; a single flexible wire with a first end connected to the ring; and a cap at a distal end of the pylon to prevent the ring from displacing past the distal end. The system also includes a model airplane including: a fuselage; first and second wings connected to the fuselage; and a control system including: a battery; a receiver powered by the battery and arranged to receive radio frequency signals; and a computer powered by the battery, electrically connected to the receiver, and arranged to transmit control signals in response to the received radio frequency signals. The airplane includes a first motor powered by the battery and arranged to receive the transmitted control signals to rotate a propeller. The single flexible wire passes through an opening in a distal end of the first wing and a second end of the single flexible wire is fixed to a point at or near a junction of the first wing and the fuselage.

DETAILED DESCRIPTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
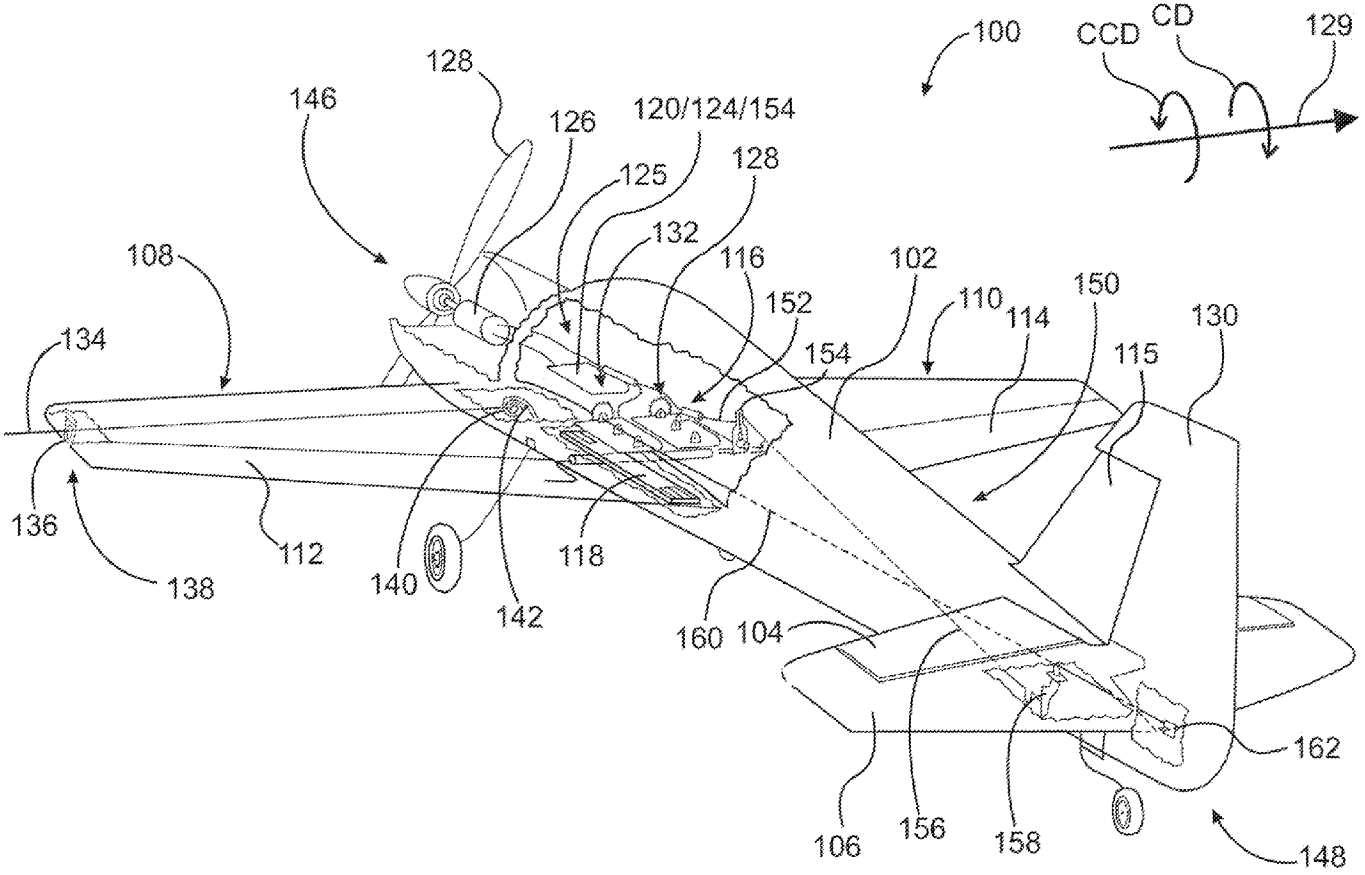
FIG. 1 is a prospective cut-away view of a radio-controlled model airplane.

FIG. 1 is a prospective cut-away view of a radio-controlled model airplane, or aircraft, 100. In the description that follows, the terms airplane and aircraft are used interchangeably. Airplane 100 includes fuselage 102, horizontal stabilizer 104 with controllable rear elevator 106 connected, for example, hingedly connected, to the horizontal stabilizer, and wings 108 and 110 including controllable flaps 112 and 114 connected, for example, hingedly connected, to the first and second wings, respectively. The airplane also includes tail fin 115 and control system 116 including battery 118, and receiver 120 powered by the battery and arranged to receive radio frequency signals from a transmitter (not shown), and computer 124 powered by the battery, electrically connected to the receiver, and arranged to transmit control signals in response to the received radio frequency signals. In an example embodiment, the receiver operates at 2.4 GHz; however, it should be understood that other frequencies are possible. In an example embodiment, the receiver and computer are on single electronic board 125; however, it should be understood that other configurations are possible. Motor 126 is powered by the battery and arranged to receive the transmitted control signals to rotate propeller 128. That is, the propeller provides the force to launch and sustain the airplane in flight according to signals received by the receiver and transmitted by the computer.

Aircraft 100 is not restricted to any particular configuration or shape, except as needed to implement the configurations and functions described below. Receiver 120 and computer 124 can be any receiver and computer known in the art. In an example embodiment, computer 124 is a microprocessor. Motor 126 can be any motor known in the art. Receiver 120 can receive signals from any radio frequency transmitter known in the art. The battery can be any battery known in the art, for example, including, but not limited to, a rechargeable and replaceable LiPO battery of 3.7 volts with a capacity of 150 MAH In an example embodiment, the airplane includes motor 128 powered by the battery and arranged to receive the transmitted control signals to swivel elevator 106 or flaps 112 and 114. For example, motor 128 is arranged to perform the following operations:

1. Swivel, with respect to a same frame of reference (indicated by arrow 129), flaps 112 and 114 in clockwise direction CD and to swivel the rear elevator in counter clockwise direction CCD; or, 2. Swivel, with respect to the same frame of reference, flaps 112 and 114 in direction CCD and the rear elevator in the direction CD.

Thus, using a single motor 128 and a linkage system described below, computer 124 is able to control flaps 112 and 114 and flaps 106 simultaneously. Motor 128 can be any motor known in the art. In an example embodiment, motor 128 is a servo-motor.

In an example embodiment, the tail fin includes rudder 130 which is fixed with respect to the tail fin. For example, the rudder is in a "zero" position of maximum alignment with the tail fin, or the rudder is at a fixed angle with respect to the tail fin, for example, to maintain tension on the guide wire noted below. In an example embodiment, rudder 130 is displaceable, for example, the rudder is hingedly connected to the tail fin, and the airplane includes motor 132 powered by the battery and arranged to receive the transmitted control signals. Motor 132 is arranged to swivel the rudder in response to the control signals from the computer. Motor 132 can be any motor known in the art. In an example embodiment, motor 132 is a servo-motor. In an example embodiment, the computer is arranged to transmit the control signals to simultaneously control motors 128 and 132.

Airplane 100 includes single flexible wire 134 passing through opening 136 at distal end 138 of one of the wings, for example, the wing pointing inward as the plane traverses a circular path. As shown in the figures, airplane 100 is oriented to fly in a counterclockwise direction (looking down from above the airplane); therefore, opening 136 is located on wing 108. If airplane 100 is oriented to fly in a clockwise direction (looking down from above the airplane); opening 136 is located on wing 110. End 140 of the wire is fastened to point 142 at or near a junction of the fuselage and the wing, for example, wing 108, upon which opening 136 is located. In an example embodiment, the wire passes through an internal space in the wing from opening 136 to point 142. Second end 144 of the wire, not shown in FIG. 1, but shown in FIG. 4 below, is arranged for connection to a point outside of the model airplane. The single flexible wire is used solely to guide the airplane and restrain the airplane to a circular flight path as further described below. However, the flexibility of the wire enables the airplane to fly within the circular flight path as further described below. The wire is not used to transmit power or control signals to the model airplane.

Figure 2:
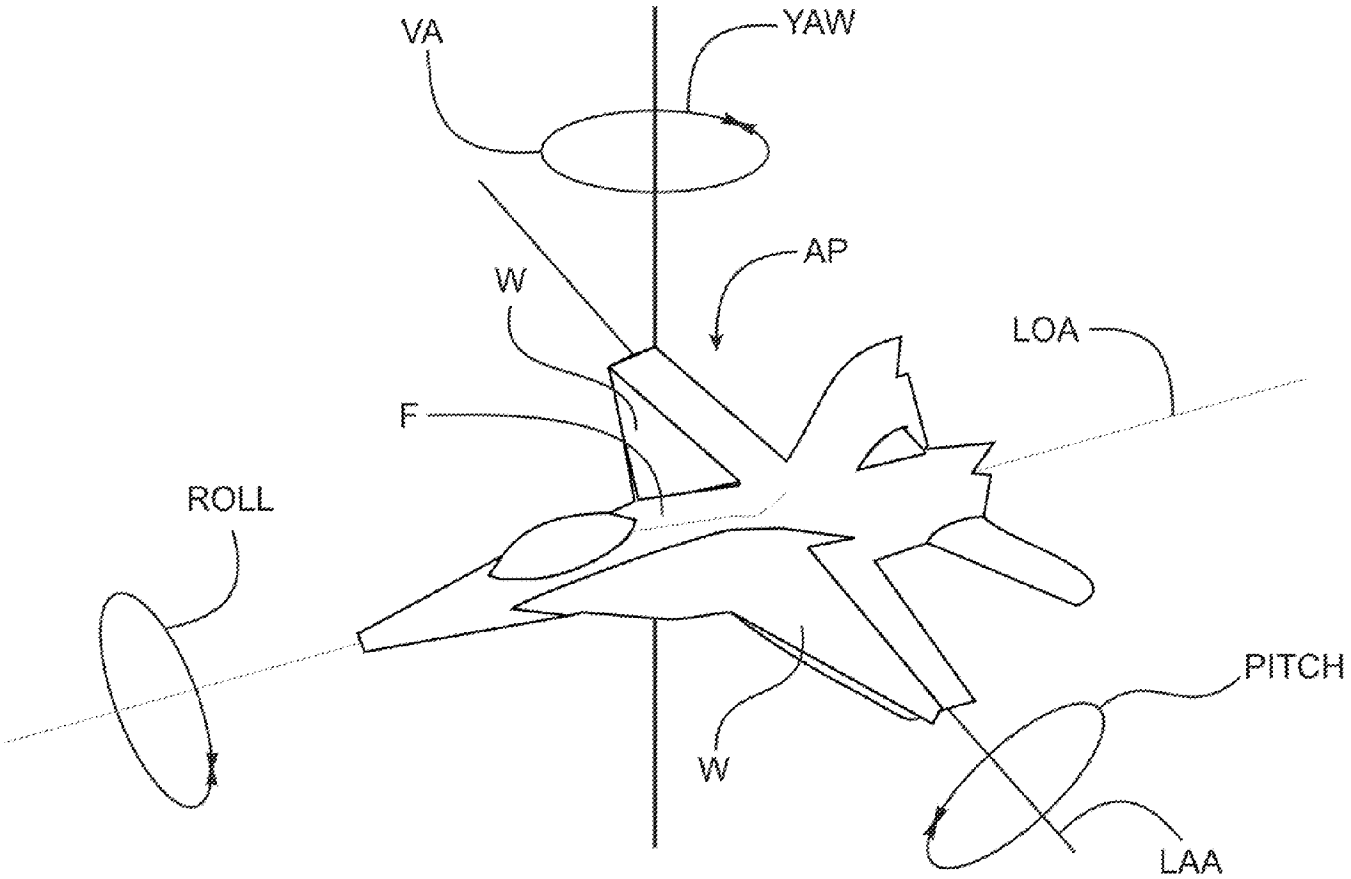
FIG. 2 is a representation of reference axes for an aircraft.

FIG. 2 is a representation of reference axes for aircraft AP. It should be understood that the location of the axes in FIG. 2 is substantially applicable to airplane 100. Longitudinal axis LOA passes through fuselage F of airplane AP, substantially from tail to nose. "Roll" is movement or rotation about LOA. Lateral axis LAA passes through wings W and fuselage F and is perpendicular to LOA. "Pitch" is movement or rotation about LAA. Vertical axis VA passes through F and is perpendicular to LOA and LAA. "Yaw" is movement or rotation about VA. As in known in the art, the exact locations and intersects of the axes depends on the specifics of a particular airplane, for example, the configuration and propulsion system of the airplane.

The following should be viewed in light of FIGS. 1 and 2. Advantageously, the presence of wire 134 and the positioning of opening 136 and point 142 enable desirable stability of airplane 100 while in flight, combined with optimal sensitivity to control commands. In an example embodiment, the location of point 142 is selected through careful analysis of the structure, configuration, and flight characteristics of airplane 100 such that when flaps 112 and 114 are at a position of greatest alignment with wings 108 and 110, respectively, and flaps 106 are at positions of greatest alignment with the horizontal stabilizer, the model airplane is arranged to fly with LOA horizontal. That is, airplane 100 flies in a steady horizontal plane without "pitch." The respective positions of greatest alignment described above for flaps 112 and 114 and flaps 106 are referred to as "zero positions" in the art. For example, swiveling the flaps out of the zero positions causes some type of pitch. Without the careful placing of point 142 undesirable pitch occurs. For example, if point 142 is too close to nose 146 of airplane 100, the nose pitches downward and if point 142 is too close to tail 148 of airplane 100, the nose pitches upward.

As further described below, wire 134 has a length defining a circular flight path for the model airplane. In an example embodiment, the location of opening 136, in particular with respect to LOA, is selected through careful analysis of the structure, configuration, and flight characteristics of airplane 100 such that when the rudder is in a position of greatest alignment with the tail fin, the model airplane is arranged to fly at a constant tangent with respect to the circular path. That is, airplane 100 flies without undesirable yaw. For example, nose 146 does not point too far inward of the circular path or too far outward of the circular path. The position of greatest alignment described above for the rudder is referred to as "zero position" in the art. For example, swiveling the rudder out of the zero positions causes yaw. Without the careful placing of opening 136 undesirable yaw occurs. For example, if point 142 is too close to nose 146 of the airplane, the nose yaws inward of the flight path and if opening 136 is too close to tail 148 of the airplane, the nose yaws outward of the flight path.

The location of point 142 influences the handling characteristics of airplane 100. For example, is point 142 is too close to nose 146 the response of airplane 100 to control is undesirably sluggish, and if point 142 is too close to tail 148 the response of airplane 100 to control is undesirably sensitive and unstable.

Airplane 100 includes linkage system 150 connecting motors 128 and 132 to flaps 106 and flaps 112 and 114, and the rudder, respectively. In an example embodiment, system 150 includes pushrod 152 connected to motor 128 and control horn 154 in order to actuate the swiveling of flaps 112 and 114. Control horn 154 transmits this motion through pushrod 156 to control horn 158 connected to flaps 106. Thus, the linkage system enables the synchronized motion of flaps 112 and 114 and elevator 106 noted above. Thus, motor 128 provides a linear movement through pushrods 152 and 156 to control horns 154 and 158 in order to move flaps 112 and 114 and elevator 106 in tandem. Therefore, a single motor is used to execute two mechanical commands (flaps 112 and 114 and elevator 106, respectively), eliminating the need for a second motor, which advantageously reduces the weight of aircraft 100. The reduction in weight increases performance, and provides the operator with more precise control of aircraft 100. Via the aerodynamic principle of moving flaps 112 and 114 and elevator 106 in unison and in opposite directions, the aircraft is able to optimally create moment and lift at the same time allowing the operator of the model aircraft to generate sharper turns (corners) and loops which in turn allows for better performance indoors and in smaller space environments.

In an example embodiment, system 150 includes pushrod 160 connected to motor 132 and control horn 162 in order to actuate the swiveling of the rudder. It should be understood that system 150 is not limited to the components and configuration shown and that other components and configurations are possible.

Figure 3A:
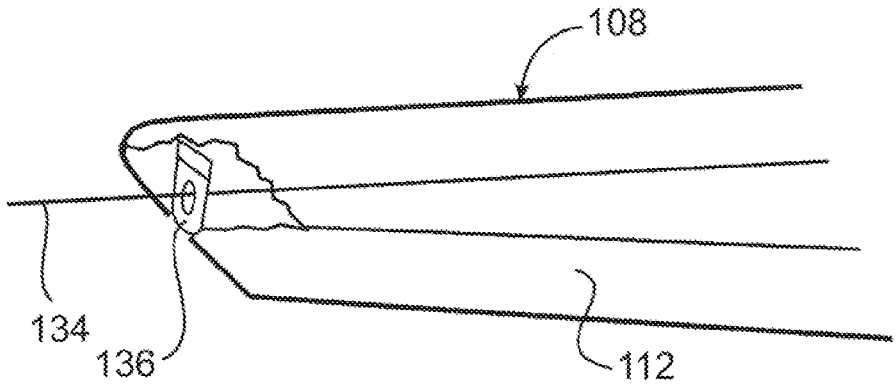
FIGS. 3A-C are details of a distal end of a wing for the airplane shown in FIG. 1.
Figure 3B:
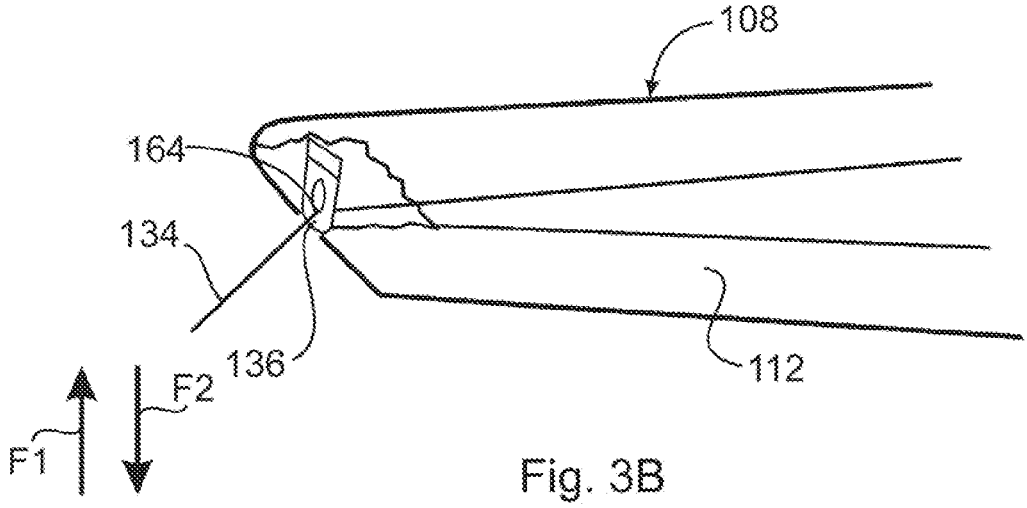
Figure 3C:
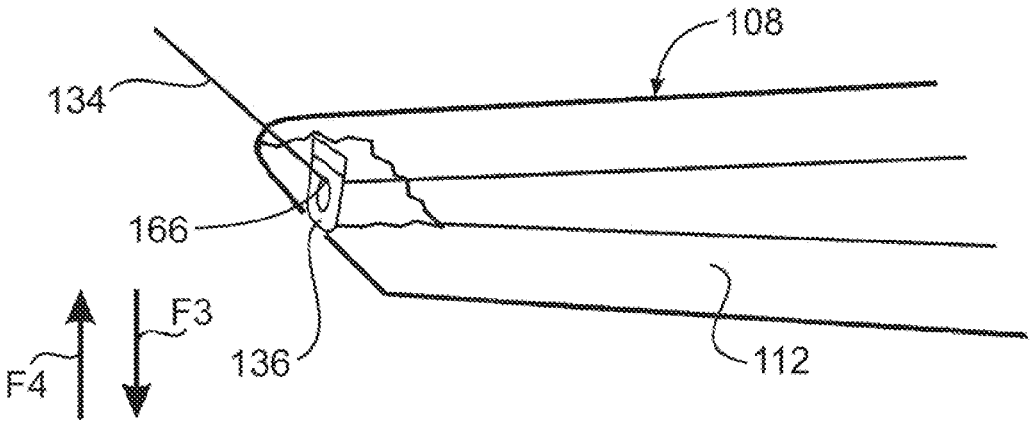

FIGS. 3A-C are details of a distal end of a wing for airplane 100. The presence of the wire in wing 108 or wing 110 also enables desirable flight characteristics and a desirable flight path for airplane 100. The following description is with respect to wing 108; however, it should be understood that the description also is applicable to wing 110. In general, as airplane 100 flies in the circular path noted above and wire 100 is substantially taut, forces exerted by the wire, in particular at distal end 138, urge wing 108 upward or downward such that end 140 of the wire, opening 136, and the other end of the wire are in a straight line, that is, are aligned, as shown in FIG. 3A. If end 138 rolls upward too far, as shown in FIG. 3B, bottom edge 164 of opening 136 contacts the wire and exerts force F1 on the wire so that the ends of the wire are no longer aligned through opening 136. However, the wire reacts to F1 with opposite force F2, pushing end 138 down so that the configuration shown in FIG. 3A is attained. If end 138 rolls downward too far, as shown in FIG. 3C, top edge 166 of opening 136 contacts the wire and exerts force F3 on the wire so that the ends of the wire are no longer aligned through opening 136. However, the wire reacts to F3 with opposite force F4, pushing end 138 up so that the configuration shown in FIG. 3A is attained. Thus, wire 134 provides automatic stabilization with respect to roll about LOA. The operation of wire 134 is further described below.

Figure 4:
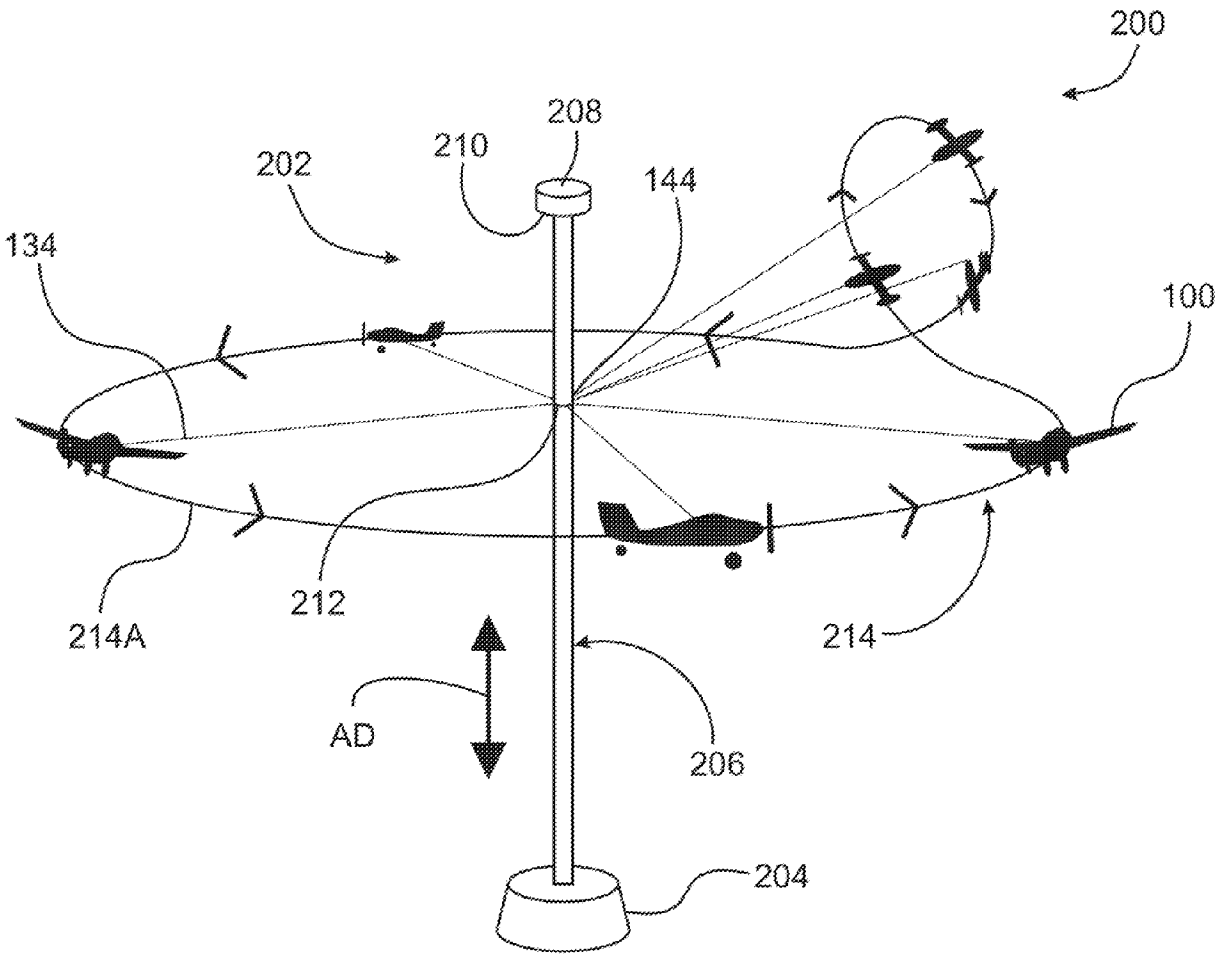
FIG. 4 is a perspective view of a model airplane system.

FIG. 4 is a perspective view of model airplane system 200. Model airplane system 200 includes anchoring system 202 and airplane 100. System 200 is shown with a single airplane 100; however, it should be understood that system is not limited to a single airplane 100 and that a plurality of airplanes 100 can be used in system 200. Further, it should be understood that if a plurality of airplanes 100 are used in system 200, different types of airplanes 100 can be used. By different types of airplanes 100 we mean that the shape and configurations of the airplanes can vary as long as the airplanes include the applicable structure and function described above and below for airplane 100. System 202 includes base 204, pylon 206 fixedly secured to the base, cap 208 at distal end 210 of the pylon, and ring 212 disposed about the pylon, rotatable about the pylon, and displaceable along a length of the pylon. That is, ring 212 fits loosely enough about the pylon such that the ring can rotate around the pylon and be moved up and down along the pylon in direction AD. Base 204 can be a hollow reservoir base to be filled with water, sand or gravel in order to add weight to stabilize the centrifugal force created by the aircraft, and the pylon can be fixed in the middle of the base. The pylon can be made of multiple segments to allow for height adjustment. The ring or rings fit loosely about the pylon to allow the aircrafts to fly around the pylon at variable speeds. Since the rings slide vertically, the rings adapt themselves to the desired altitude of the aircraft as the operator controls the aircraft via flaps 106 and flaps 112 and 114. The cable is thin and flexible and has any desired length in order to fit enclosed indoor spaces or outdoors. The only function of the cable is to tether the aircraft to the ring and pylon.

End 144 of wire 134 is fixedly connected to the ring. The cap prevents the ring from displacing past the distal end, that is, the ring cannot slide over the cap. Any base, pylon, cap, or ring known in the art can be used. It should be understood that other configurations are possible, with the general understanding that a ring is rotatable about and axially displaceable along a fixed element such as a pylon that is securely anchored. As described above, end 140 of the wire is connected to point 142 in airplane 100.

As noted above, the location of point 142 is selected through careful analysis of the structure, configuration, and flight characteristics of airplane 100 such that when flaps 112 and 114 are at a position of greatest alignment with wings 108 and 110, respectively, and elevator 106 are at a position of greatest alignment with the horizontal stabilizer, the model airplane is arranged to fly with LOA horizontal. In portion 214A of the circular flight path, airplane 100 is flying with LOA horizontal.

Figure 5:
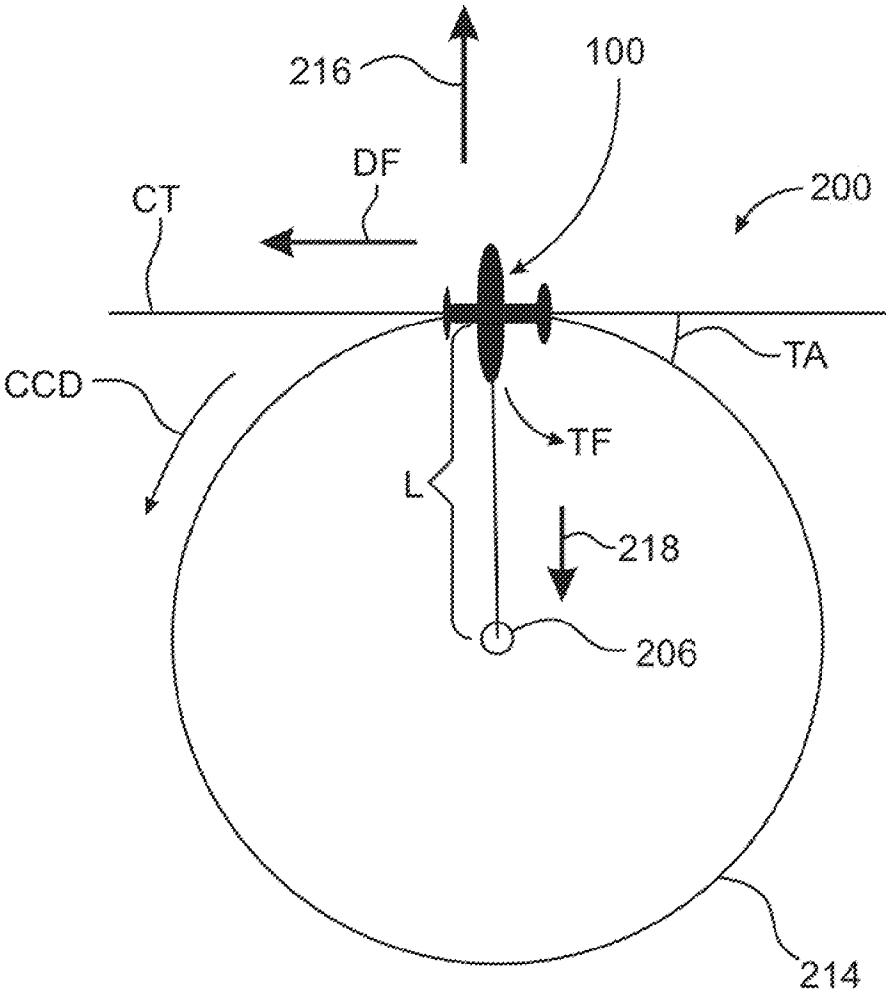
FIG. 5 is a plan view of the model airplane system of FIG. 4 showing the airplane of FIG. 1 flying at a constant tangent.

FIG. 5 is a plan view of system 200 showing airplane 100 flying at a constant tangent. The following should be viewed in light of FIGS. 1 through 5. As noted above, wire 134 has length L defining circular flight path 214 for the model airplane. L is not restricted to any particular value. L can be relatively short, for example, 8 feet, to enable use of system 200 within a room or L can be longer for use of system 200 outdoors. As noted above, the location of opening 136, in particular with respect to LOA, is selected through careful analysis of the structure, configuration, and flight characteristics of airplane 100 such that when the rudder is in a position of greatest alignment with the tail fin, the model airplane is arranged to fly at constant tangent CT with respect to the circular path. That is, angle TA between CT and 214 remains constant and airplane 100 flies without undesirable yaw. The operation of airplane 100 in FIG. 5 can be explained as follows. The airplane flies in direction CCD and force DF acts to keep the airplane moving in direction CCD. Centrifugal force 216 pushes the plane outward and centripetal force 218 pulls the plane inward (with respect to the pylon). The key to the stability and the ability of the airplane to maintain the constant tangent is tension force TF generated by the wire in reaction to the direction force. When point 144 is properly selected, the combination of forces results in the airplane maintaining the constant tangent.

If the guide wire does not pass through the wing and is only attached to the fuselage, undesirable yaw of the nose occurs, for example, inward or outward of the flight path. As a result, the airplane assumes an undesirable orientation, for example, LOA of the airplane crosses the circular flight path (the nose points more toward or more away from a center point for the circular path) rather than being tangential to the circular flight path. If opening 136 is improperly placed undesirable yaw also occurs, for example, if the opening is too close to tail 148 of the airplane, the nose yaws outward of the flight path.

The use of a single flexible guide wire in conjunction with the positioning of the guide wire and the controllability of elevator 106, flaps 112 and 114, and the rudder enable a wide-ranging and complex set of maneuvers for airplane 100. For example, returning to FIG. 4, the airplane is shown performing an internal loop. In this case, elevator 106 and flaps 114 and 114 are swiveled to enable the loop and the guide wire and the positioning of the guide wire enable the airplane to remain stable during the loop.

Figure 6:
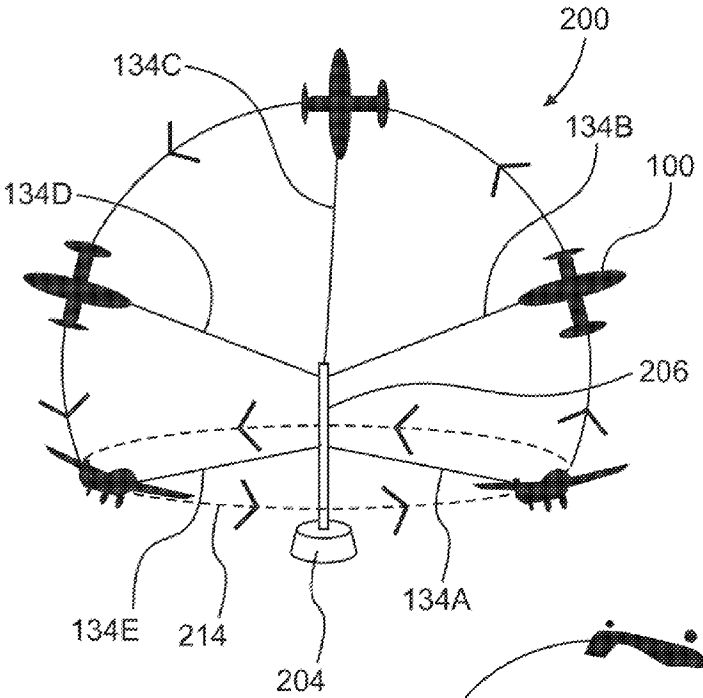
FIG. 6 is a perspective view of the model airplane system of FIG. 4 showing the airplane of FIG. 1 flying above the cap of the pylon; and, FIG. 7 is a perspective view of the model airplane system of FIG. 4 showing the airplane of FIG. 1 performing a figure 8.

FIG. 6 is a perspective view of model airplane system 200 showing airplane 100 flying above the cap on the pylon. The use of a single flexible guide wire in conjunction with the positioning of the guide wire and the controllability of elevator 106, flaps 112 and 114, and the rudder also enable the airplane to fly above the cap. This capability increases the vertical maneuvers possible in system 200. Approximate sequential positions of wire 134 in the sequence of FIG. 6 are shown by numerals 134A-E.

Figure 7:
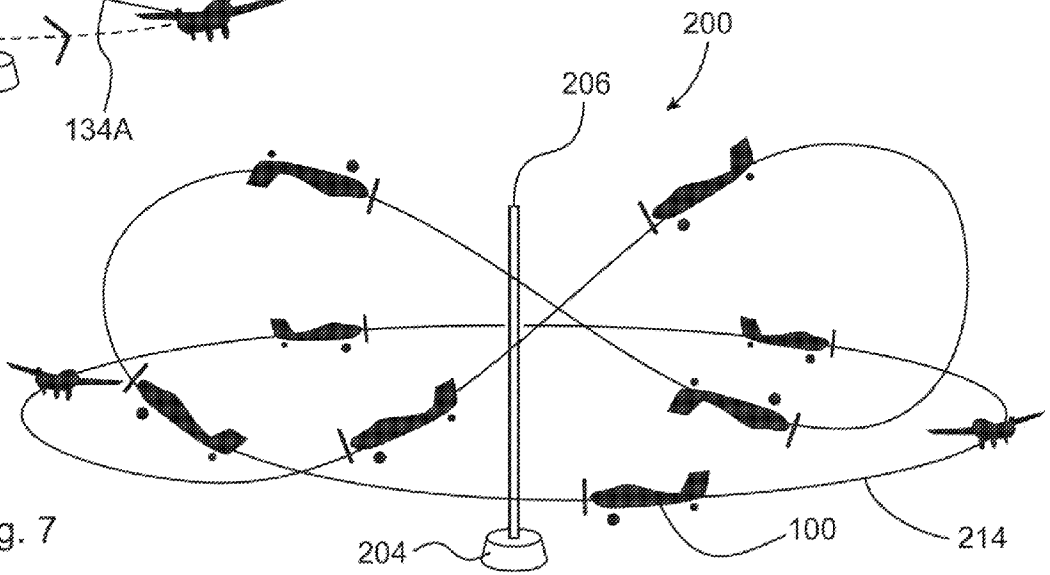

FIG. 7 is a perspective view of model airplane system 200 showing airplane of 100 performing a figure 8. Since guide wire 134 is flexible, airplane 100 is able to fly within circular flight path 214. For example, the rudder can be used to move the airplane inward of path 214. Thus, as shown in FIG. 7 a complicated figure 8 pattern, which requires the airplane to fly above the cap, perform loops, and fly inward of path 214 is accomplished. To clarify the view of FIG. 7, the guide wire has not been shown.

Thus, airplane 100 is a totally wirelessly radio controlled tethered model scale airplane able to take off, land, climb, accelerate, dive, perform loops, vertical flight, knife flight, Cuban eight, stalls, inverted flight, flips, regular eight, square loops, and many three dimensional flight maneuvers while the operator is situated remotely outside the flight circumference. The preceding motion occurs within flight paths that are prescribed in an outward direction by flight path 214 and length L of the wire which form a dome-capped right angle cylinder. However, as noted above, for example, as shown in FIG. 7, flight within the cylinder is possible.

In general, the centrifugal force created by the airplane will tend to tense the guide wire as this force urges the airplane away from the pylon. However, through the use of the controllable rudder, the airplane also can fly inside the circumference of the cylinder.

In an example embodiment, the RPM of motor 126 are regulated by electronic speed control (ESC) 154, which is also located in the aircraft, for example, associated with computer 124. This arrangement enables the operator to regulate the speed of the aircraft. To accomplish this control wirelessly, the aircraft used the radio frequency control signals noted above. Computer 124 transmits control signals to the ESC that open or close the throttle of motor 126 to regulate the speed of airplane 100 and converts the radio frequency control signals into an electronic signal in order to command motors 128 and 132 which in turn convert these electronic commands into lineal mechanical commands to actuate elevator 106, flaps 112 and 114, and the rudder.

Thus, it is seen that the objects of the invention are efficiently obtained, although changes and modifications to the invention should be readily apparent to those having ordinary skill in the art, without departing from the spirit or scope of the invention as claimed. Although the invention is described by reference to a specific preferred embodiment, it is clear that variations can be made without departing from the scope or spirit of the invention as claimed.

What is claimed is:

1. A radio-controlled model airplane, comprising:

a horizontal stabilizer with a controllable rear elevator hingedly connected to the horizontal stabilizer;

first and second wings including first and second controllable flaps hingedly connected to the first and second wings, respectively;

a control system including:

a battery;

a receiver powered by the battery and arranged to receive radio frequency signals; and, a computer powered by the battery, electrically connected to the receiver, and arranged to transmit control signals in response to the received radio frequency signals;

a first motor powered by the battery and arranged to receive the transmitted control signals to rotate a propeller; and, a second motor powered by the battery and arranged to receive the transmitted control signals to:

swivel, with respect to a same frame of reference, the first and second flaps in a clockwise direction and to swivel the rear elevator in a counter clockwise direction; or, swivel, with respect to the same frame of reference, the first and second flaps in the counterclockwise direction and the rear elevator in the clockwise direction.

2. The model airplane of claim 1 further comprising:

a third motor powered by the battery and arranged to receive the transmitted control signals; and, a rudder hingedly connected to a tail fin, wherein the third motor is arranged to swivel the rudder in response to the control signals from the computer.

3. The model airplane of claim 2 wherein the control signals are arranged to simultaneously control the second and third motors.

4. The model airplane of claim 1 further comprising:

a fuselage to which the first and second wings and the horizontal stabilizer are attached; and, a single flexible wire:

passing through an opening at the distal end of the first wing;

with a first end fastened to a point at or near a junction of the first wing and the fuselage; and, a second end arranged for connection to a point outside of the model airplane, wherein the single flexible wire is not used to transmit power or control signals to the model airplane.

5. A radio-controlled model airplane, comprising:

a fuselage;

first and second wings connected to the fuselage;

a control system including:

a battery;

a receiver powered by the battery and arranged to receive radio frequency signals; and, a computer powered by the battery, electrically connected to the receiver, and arranged to transmit control signals in response to the received radio frequency signals;

a first motor powered by the battery and arranged to receive the transmitted control signals to rotate a propeller; and, a single flexible wire:

passing through an opening in a distal end of the first wing;

with a first end fixed to a point at or near a junction of the first wing and the fuselage; and, with a second end for connection to a point outside of the model airplane.

6. The radio-controlled model airplane of claim 5, further comprising:

a second motor powered by the battery; and, a rear elevator connected to a horizontal stabilizer, wherein:

the first and second wings include first and second flaps, respectively; and, the second motor is arranged to receive the transmitted control signals to swivel the first and second flaps or the rear elevator.

7. The radio-controlled model airplane of claim 6, further comprising:

a longitudinal axis passing through the fuselage; and, a lateral axis, perpendicular to the longitudinal axis, passing through the fuselage and the first and second wings, wherein the point at or near the junction of the first wing and the fuselage is positioned so that when the first and second flaps are at a position of greatest alignment with the first and second wings, respectively, and the rear elevator is at a position of greatest alignment with the horizontal stabilizer, the model airplane is arranged to fly with the longitudinal axis horizontal.

8. The radio controlled model airplane of claim 5 further comprising:

a second motor powered by the battery and arranged to receive the transmitted control signals; and, a rudder connected to a tail fin, wherein:

the single flexible wire has a length defining a circular flight path for the model airplane;

the second motor is arranged to swivel the rudder in response to the transmitted control signals; and, the opening in the distal end of the first wing is positioned so that when the rudder is in a position of greatest alignment with the tail fin, the model airplane is arranged to fly at a constant tangent with respect to the circular path.

9. The radio-controlled model airplane of claim 5, wherein when the model airplane is being propelled by the first motor a force exerted by the single flexible wire urges the model airplane to fly such that the opening in the distal end of the wing and the first and second ends of the wire are aligned.

10. A model airplane system, comprising:

an anchoring system including:

a base;

a pylon fixedly secured to the base;

a ring disposed about the pylon, rotatable about the pylon, and displaceable along a length of the pylon;

a single flexible wire with a first end connected to the ring; and, a cap at a distal end of the pylon to prevent the ring from displacing past the distal end; and, a radio-controlled model airplane including:

a horizontal stabilizer with a rear elevator connected to the horizontal stabilizer;

first and second wings including first and second flaps connected to the first and second wings, respectively;

a control system including:

a battery;

a receiver powered by the battery and arranged to receive radio frequency signals; and, a computer powered by the battery, electrically connected to the receiver, and arranged to transmit control signals in response to the received radio frequency signals;

a first motor powered by the battery and arranged to receive the transmitted control signals to rotate a propeller; and, a second motor powered by the battery and arranged to receive the transmitted control signals to:

swivel, with respect to a same frame of reference, the first and second flaps in a clockwise direction and to swivel the rear elevator in a counter clockwise direction; or, swivel, with respect to the same frame of reference, the first and second flaps in the counterclockwise direction and the rear elevator in the clockwise direction.

11. The model airplane system of claim 10 wherein:

the model airplane includes:

a third motor powered by the battery and arranged to receive the transmitted control signals;

a rudder hingedly connected to a tail fin; and, the third motor is arranged to swivel the rudder in response to the control signals from the computer.

12. The model airplane system of claim 11 wherein the control signals are arranged to simultaneously control the second and third motors.

13. The model airplane system of claim 10 wherein:

the model airplane includes a fuselage to which the first and second wings and the horizontal stabilizer are attached;

the single flexible wire passes through an opening at the distal end of the first wing; and, a second end of the single flexible wire is fastened to a point at or near a junction of the first wing and the fuselage.

14. A model airplane system, comprising:

an anchoring system including:

a base;

a pylon fixedly secured to the base;

a ring disposed about the pylon, rotatable about the pylon, and displaceable along a length of the pylon;

a single flexible wire with a first end connected to the ring; and, a cap at a distal end of the pylon to prevent the ring from displacing past the distal end; and, a model airplane including:

a fuselage;

first and second wings connected to the fuselage;

a control system including:

a battery;

a receiver powered by the battery and arranged to receive radio frequency signals; and, a computer powered by the battery, electrically connected to the receiver, and arranged to transmit control signals in response to the received radio frequency signals; and, a first motor powered by the battery and arranged to receive the transmitted control signals to rotate a propeller, wherein:

the single flexible wire passes through an opening in a distal end of the first wing; and, a second end of the single flexible wire is fixed to a point at or near a junction of the first wing and the fuselage.

15. The model airplane system of claim 14 wherein:

the model airplane includes:

a second motor powered by the battery; and, a rear elevator connected to a horizontal stabilizer;

the first and second wings include first and second flaps, respectively; and, the second motor is arranged to receive the transmitted control signals to swivel the first and second flaps or the rear elevator.

16. The model airplane system of claim 15 wherein:

the model airplane includes:

a longitudinal axis passing through the fuselage; and, a lateral axis, perpendicular to the longitudinal axis, passing through the fuselage and the first and second wings; and, the point at or near the junction of the first wing and the fuselage is positioned so that when the first and second flaps are at a position of greatest alignment with the first and second wings, respectively, and the rear elevator is at a position of greatest alignment with the horizontal stabilizer, the model airplane is arranged to fly with the longitudinal axis horizontal.

17. The model airplane system of claim 14 wherein:

the model airplane includes:

a rudder connected to a tail fin; and, a second motor powered by the battery and arranged to receive the transmitted control signals;

the single flexible wire has a length defining a circular flight path for the model airplane about the pylon;

the second motor is arranged to swivel the rudder in response to the transmitted control signals; and, the opening in the distal end of the first wing is positioned so that when the rudder is in a position of greatest alignment with the tail fin, the model airplane is arranged to fly at a constant tangent with respect to the circular path.

18. The model airplane system of claim 14 wherein when the model airplane is being propelled by the first motor a force exerted by the single flexible wire urges the model airplane to fly such that the opening in the distal end of the wing and the first and second ends of the wire are aligned.

19. The model airplane system of claim 14 wherein:

the model airplane includes:

a longitudinal axis passing through the fuselage; and, a lateral axis, perpendicular to the longitudinal axis, passing through the fuselage and the first and second wings; and, when the model airplane is being propelled by the first motor such that the point on the fuselage is aligned with a line perpendicular to the pylon, a force exerted by the single flexible wire urges the model airplane to fly such that the lateral axis is horizontal.

20. A radio-controlled model airplane, comprising:

a fuselage;

a horizontal stabilizer with a controllable rear elevator hingedly connected to the horizontal stabilizer;

first and second wings connected to the fuselage and including first and second controllable flaps hingedly connected to the first and second wings, respectively;

a control system including:

a battery;

a receiver powered by the battery and arranged to receive radio frequency signals; and, a computer powered by the battery, electrically connected to the receiver, and arranged to transmit control signals in response to the received radio frequency signals;

a first motor powered by the battery and arranged to receive the transmitted control signals to rotate a propeller;

a single flexible wire:

passing through an opening in a distal end of the first wing;

with a first end fixed to a point at or near a junction of the first wing and the fuselage; and, with a second end for connection to a point outside of the model airplane; and, a second motor powered by the battery and arranged to receive the transmitted control signals to:

swivel, with respect to a same frame of reference, the first and second flaps in a clockwise direction and to swivel the rear elevator in a counter clockwise direction; or, swivel, with respect to the same frame of reference, the first and second flaps in the counterclockwise direction and the rear elevator in the clockwise direction.

* * * * *